US006595731B1

(12) United States Patent
Johansson et al.

(10) Patent No.: US 6,595,731 B1
(45) Date of Patent: Jul. 22, 2003

(54) DEVICE FOR A LOADING DECK

(75) Inventors: Göran Johansson, Göteborg (SE); Bengt Ramne, Malvern, PA (US)

(73) Assignee: TTS Ships Equipment AB (SE)

( * ) Notice: Subject to any disclaimer, the term of this patent is extended or adjusted under 35 U.S.C. 154(b) by 0 days.

(21) Appl. No.: 09/979,946

(22) PCT Filed: Aug. 3, 2000

(86) PCT No.: PCT/SE00/00856

§ 371 (c)(1),
(2), (4) Date: Nov. 5, 2001

(87) PCT Pub. No.: WO00/66421

PCT Pub. Date: Nov. 9, 2000

(30) Foreign Application Priority Data

May 3, 1999 (SE) ..... 9901587

(51) Int. Cl.[7] ..... B60P 1/64

(52) U.S. Cl. ..... 410/52; 410/56; 410/65; 410/66; 410/67

(58) Field of Search ..... 410/52, 56, 57, 410/65, 66, 67, 77, 78, 80

(56) References Cited

U.S. PATENT DOCUMENTS

| | | | | | |
|---|---|---|---|---|---|
| 2,634,988 | A | * | 4/1953 | Porte | 280/81.1 |
| 2,637,453 | A | * | 5/1953 | Cleveland | 414/140.1 |
| 2,902,247 | A | * | 9/1959 | Loomis et al. | 410/80 |
| 3,392,944 | A | * | 7/1968 | Wyrough | 410/56 |
| 4,068,813 | A | * | 1/1978 | Chatwin et al. | 410/7 |
| 4,077,590 | A | * | 3/1978 | Shorey | 410/77 |
| 4,089,539 | A | * | 5/1978 | Berger | 410/80 |
| 4,805,859 | A | * | 2/1989 | Hudson | 248/148 |
| 4,929,133 | A | * | 5/1990 | Wiseman | 410/52 |
| 6,210,088 | B1 | * | 4/2001 | Crosby | 410/35 |

FOREIGN PATENT DOCUMENTS

| | | |
|---|---|---|
| FI | 74913 | 12/1987 |
| JP | 60163788 | 8/1985 |
| WO | 9730890 | 8/1987 |

* cited by examiner

*Primary Examiner*—D. Glenn Dayoan
*Assistant Examiner*—Paul Chenevert
(74) *Attorney, Agent, or Firm*—Orum & Roth

(57) ABSTRACT

An arrangement for locking cargo to a deck on board a ship is described. Lateral dividing profiles, which are arranged on and secured to the deck, and which form loading lanes, have lock accommodating openings to accept rotatable and movable locking devices from lockable loads (trailer supports and cargo cassettes) capable of being parked in the cargo lanes. Present on the loads is a mechanism, which is connected to the locking device for the purpose of locking or releasing the loads, in conjunction with a cargo vehicle, which can be driven between the lanes, is so arranged as to actuate the mechanism when the cargo vehicle passes the mechanism.

20 Claims, 20 Drawing Sheets

FIG.15
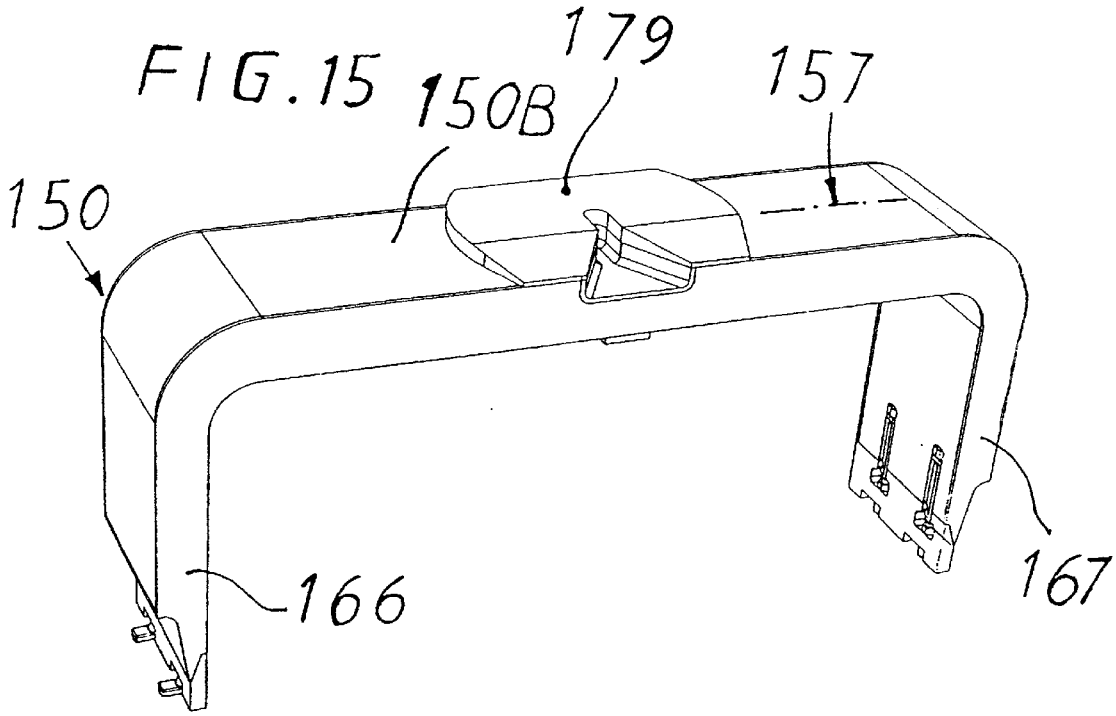
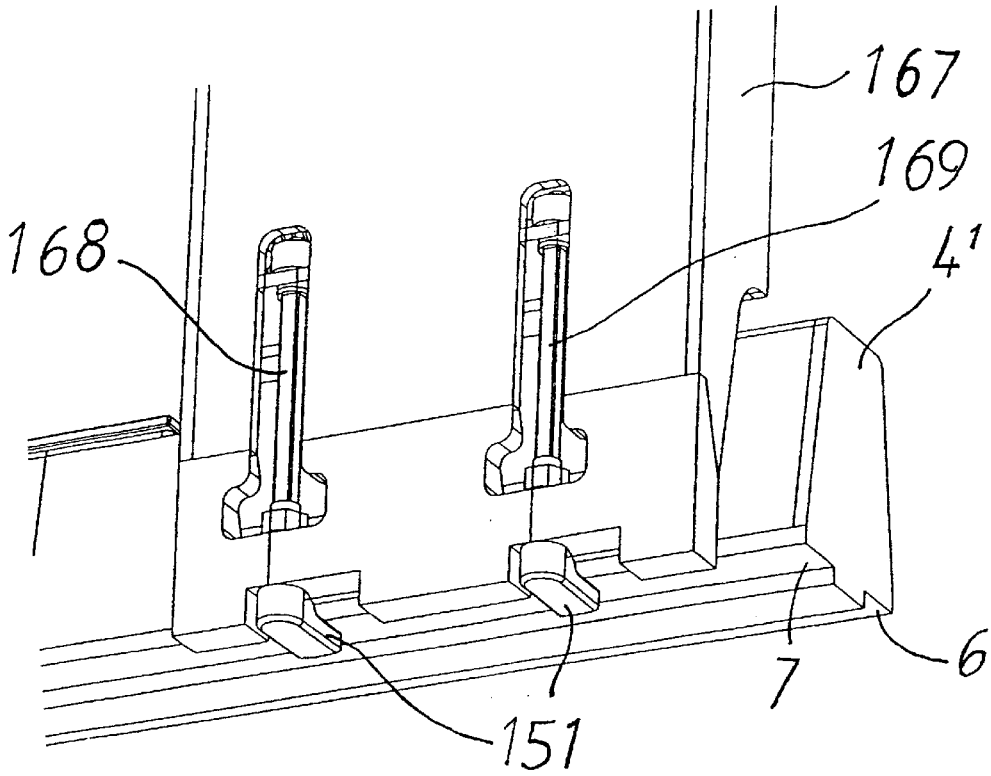
FIG.16

DEVICE FOR A LOADING DECK

CROSS REFERENCE TO RELATED APPLICATIONS

Not Applicable

STATEMENT REGARDING FEDERALLY SPONSORED RESEARCH

Not Applicable

INCORPORATION-BY-REFERENCE MATERIAL SUBMITTED ON COMPACT DISK

Not Applicable

BACKGROUND OF THE INVENTION

1. Field of the Invention

The present invention relates to an arrangement for locking cargo to a deck on board a ship.

2. Description of Related Art

Previously disclosed arrangements for locking a cargo to a deck are, for example, straps, lines and similar tensioning devices, in conjunction with which use is made of existing cargo fittings in the deck of the ship.

Securing of cargo carriers, for example cargo cassettes, is performed only at each end of a positioned row of cargo carriers with the help of counter-pressure components, while cargo trailers have previously been secured to existing cargo openings with the help of straps, for example, in accordance with the above. There previously disclosed devices did not, however, permit so-called automatic activation of the locking devices, and this has had to be performed manually, which has been dangerous and time-consuming for the personnel responsible for securing the cargo. The aforementioned previously disclosed means also did not effectively permit the close packing of freight.

BRIEF SUMMARY OF THE INVENTION

The principle object of the present invention is thus, in the first instance, to solve the aforementioned problems by simple and efficiently functioning means.

The aforementioned object is achieved by means of an arrangement in accordance with the present invention, which is characterized essentially in that lateral dividing profiles, which are capable of being laid out on the deck and secured to it, and which are so arranged as to form loading lanes between pairs of rows, exhibit either lock-accommodating openings to accept rotatable and/or movable locking devices from trailer supports and/or cargo cassettes capable of being parked in the cargo lane or locking devices capable of lateral displacement from lateral dividing profiles, which are so arranged as to interact with trailer supports, cargo vehicles, cargo cassettes and/or some other cargo capable of being parked in the cargo lane, and in that present on the trailer support and/or load cassette or lateral dividing profiles in question is a mechanism which is connected to the aforementioned locking device for the purpose of releasing it or locking it, in conjunction with which a cargo vehicle, which can be driven along and between the dividers, is so arranged as to actuate the mechanism when the cargo vehicle in question passes the mechanism.

BRIEF DESCRIPTION OF THE DRAWINGS

The invention is described below as a number of preferred illustrative embodiments, in conjunction with which reference is made to the accompanying drawings, in which:

FIGS. 9–16 show a second illustrative embodiment with cargo trailers, where:

FIG. 9 shows how a cargo container on a trailer is transported on the deck by a cargo vehicle along lateral dividing profiles positioned to the side;

FIG. 10 shows an exploded view of the system shown in FIG. 9;

FIG. 11 shows a trailer support standing on a deck and illustrated in the opened position ready for locking;

FIGS. 12–13 show details of a locking mechanism included in the trailer support with the support in a locked position;

FIG. 14 shows a bottom view of the aforementioned trailer support in a position with a locking device locked to a lateral dividing profile positioned to the side;

FIG. 15 shows the trailer support viewed in perspective at an angle from above;

FIG. 16 shows a side support leg of the trailer support with the constituent locking device in a position locked to a profile.

DETAILED DESCRIPTION OF THE INVENTION

Figure 1:
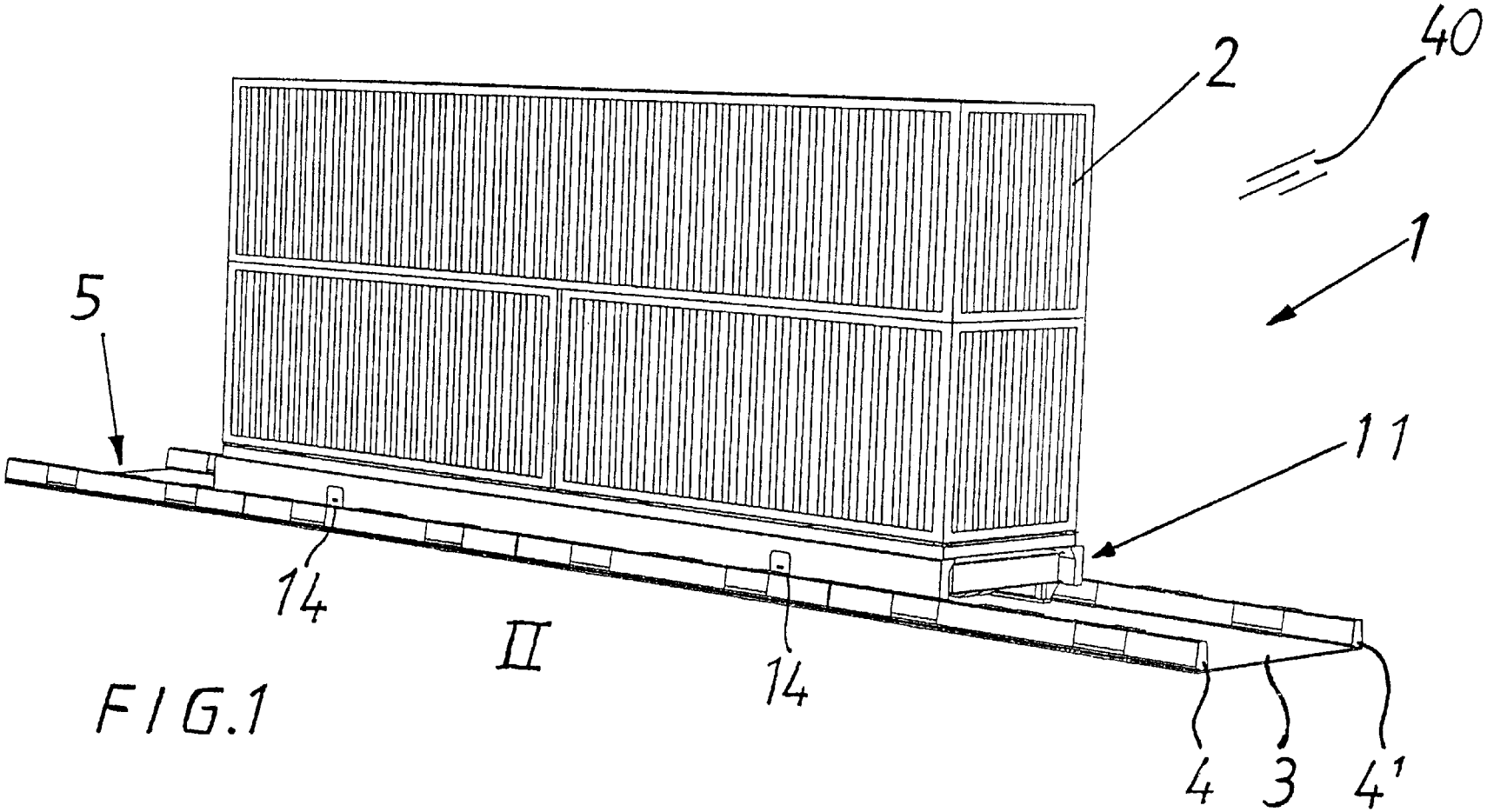
FIG. 1 shows a first example with the cargo supported on a load carrier of the cassette type and in a position in which it is loaded and locked to the deck.
Figure 2:
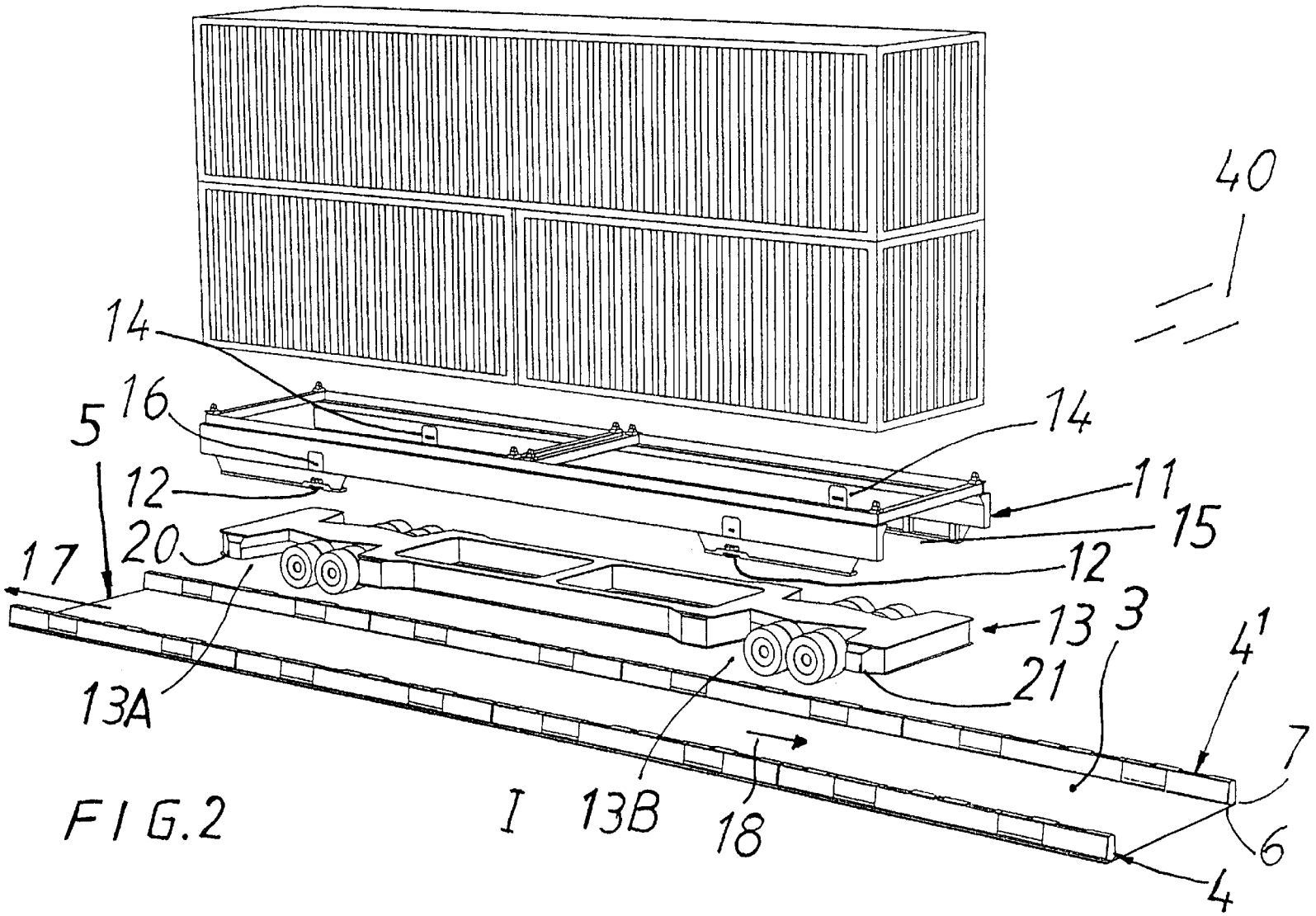
FIG. 2 shows an exploded view of the entire cargo arrangement illustrating the lateral dividing profiles laid out and secured to the deck.
Figure 3:
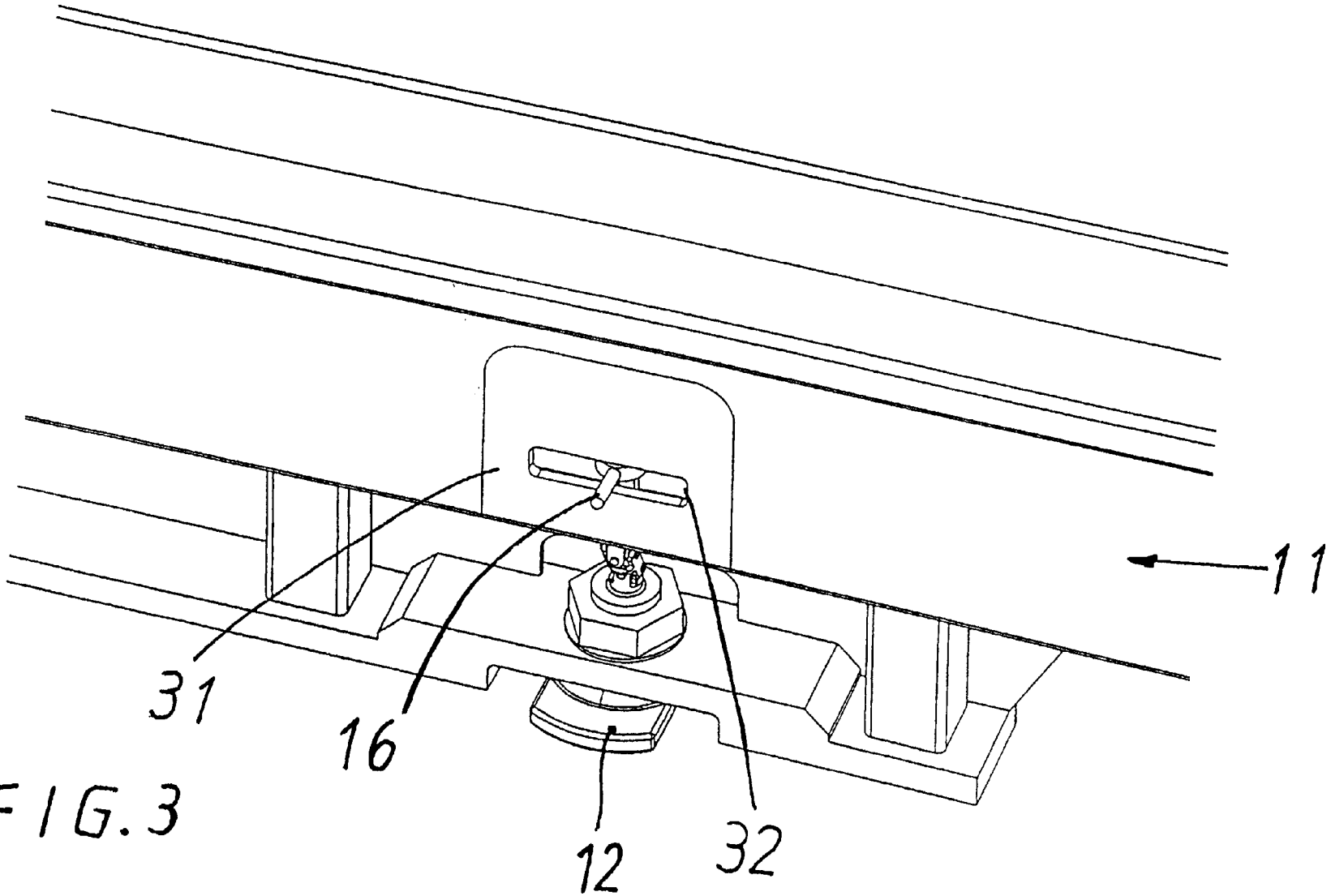
FIG. 3 shows a partial view of a locking mechanism on a cargo cassette.
Figure 4:
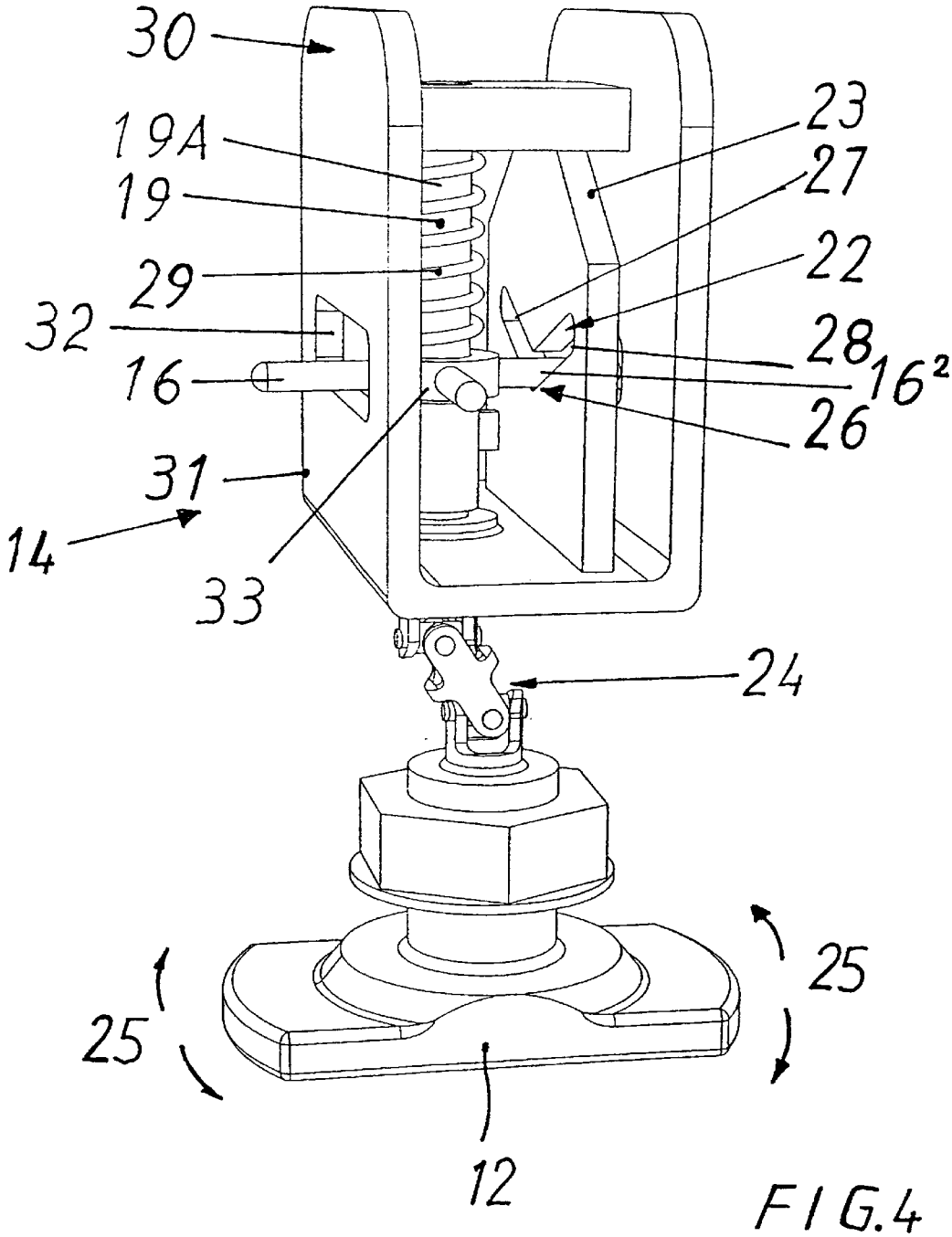
FIG. 4 shows the locking mechanism in an intended locked position.
Figure 6:
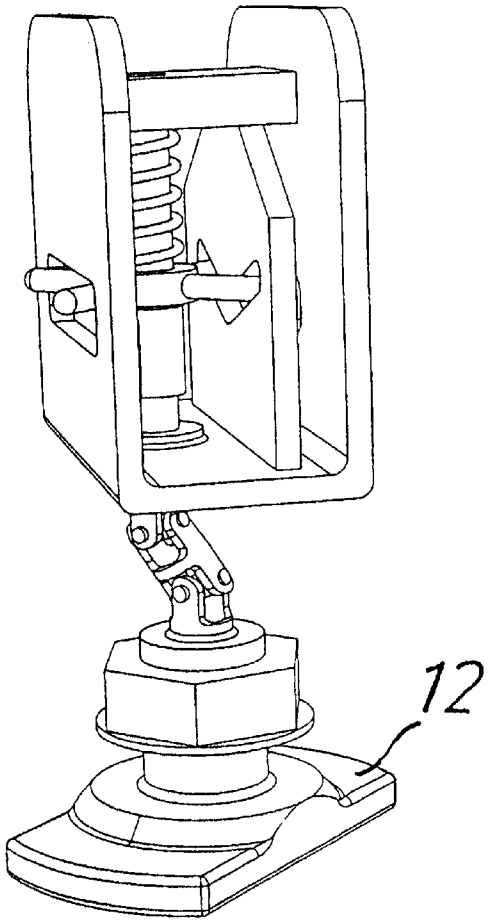
FIGS. 6–7 shows the locking mechanism in two different intermediate connection positions.
Figure 5:
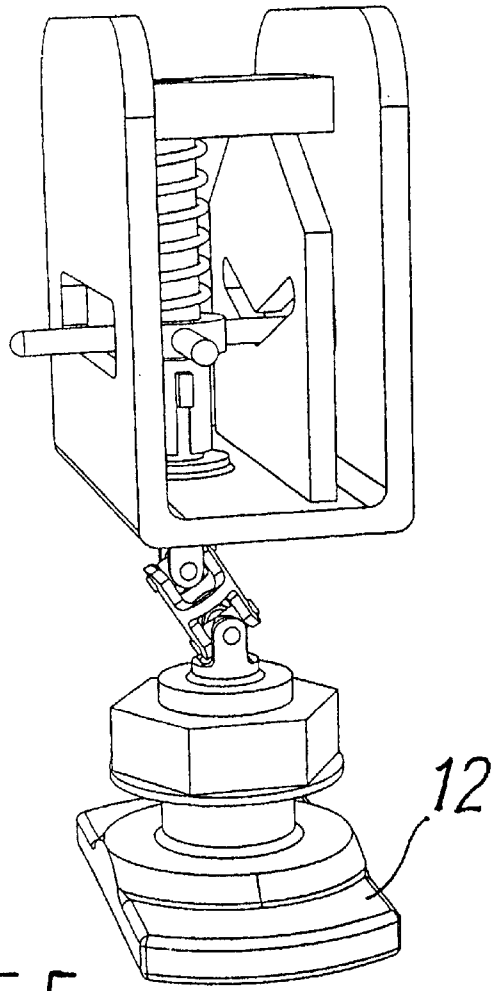
FIG. 5 shows the locking mechanism in a released position.
Figure 7:
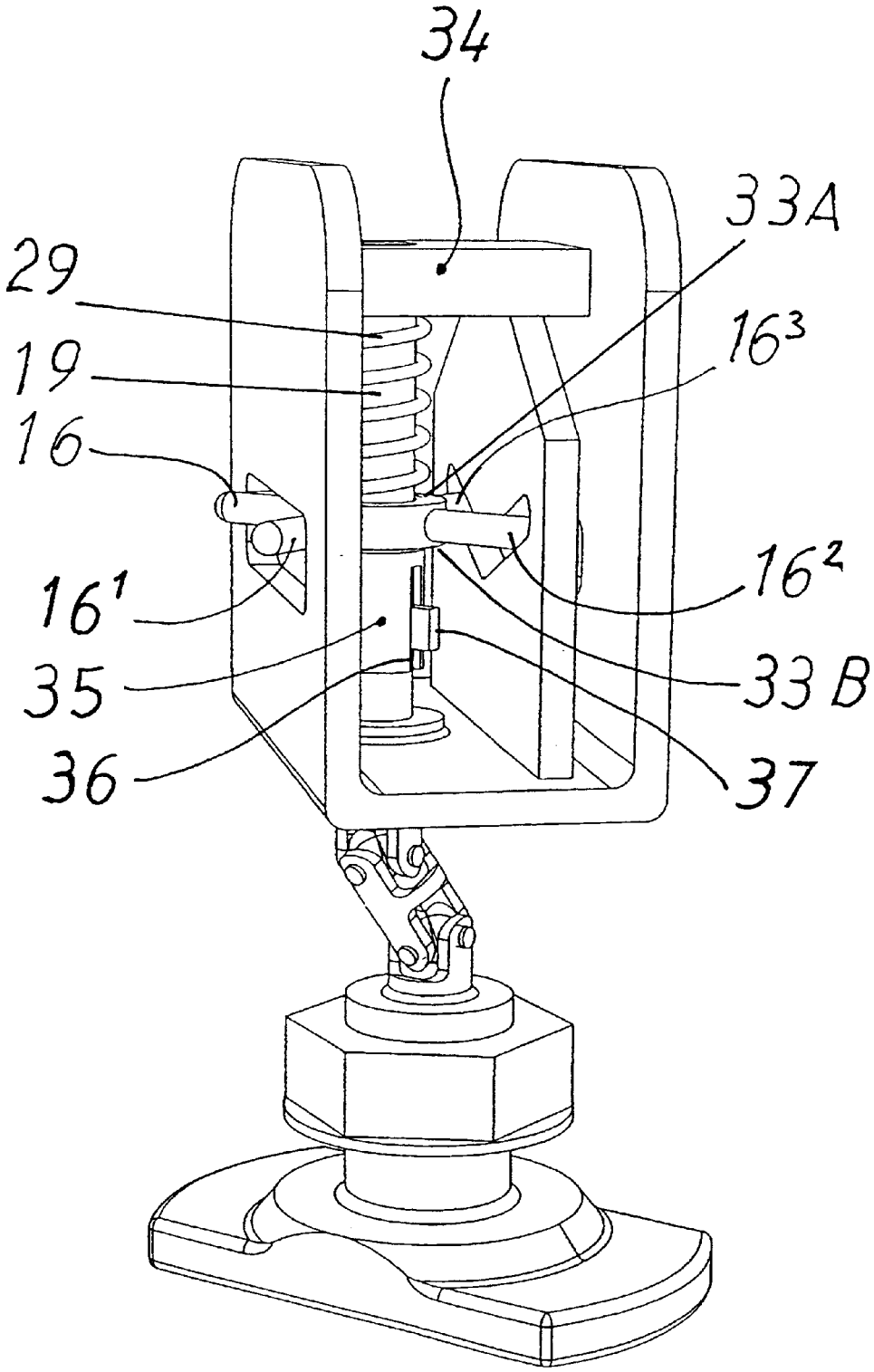

The invention, which is illustrated in the drawings, is in the form of an arrangement 1 and 101 which is arranged for the detachable locking of a cargo 2 and 102 to a deck 3 on board a ship 40 and comprises long lateral dividing profiles 4, $\mathbf{4}^1$, which are capable of being set up on the deck 3 and of being locked to the deck 3, which profiles are so arranged as to form cargo lanes 5 between pairs of profiles 4, $\mathbf{4}^1$ . . . arranged in rows.

Figure 8:
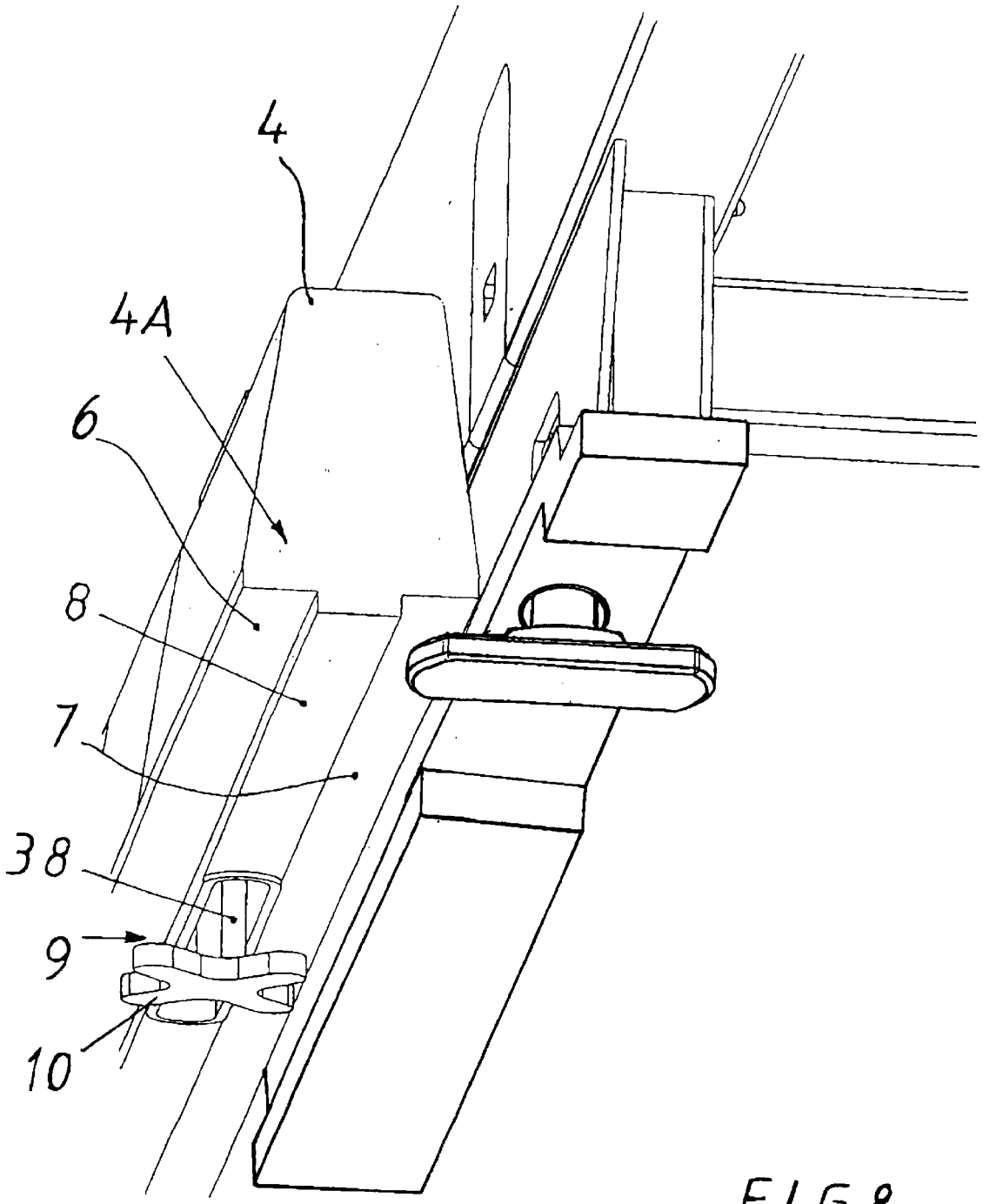
FIG. 8 shows a bottom perspective view of the load cassette and a lateral dividing profile positioned to the side with the locking mechanism in the locked position.
Figure 9:
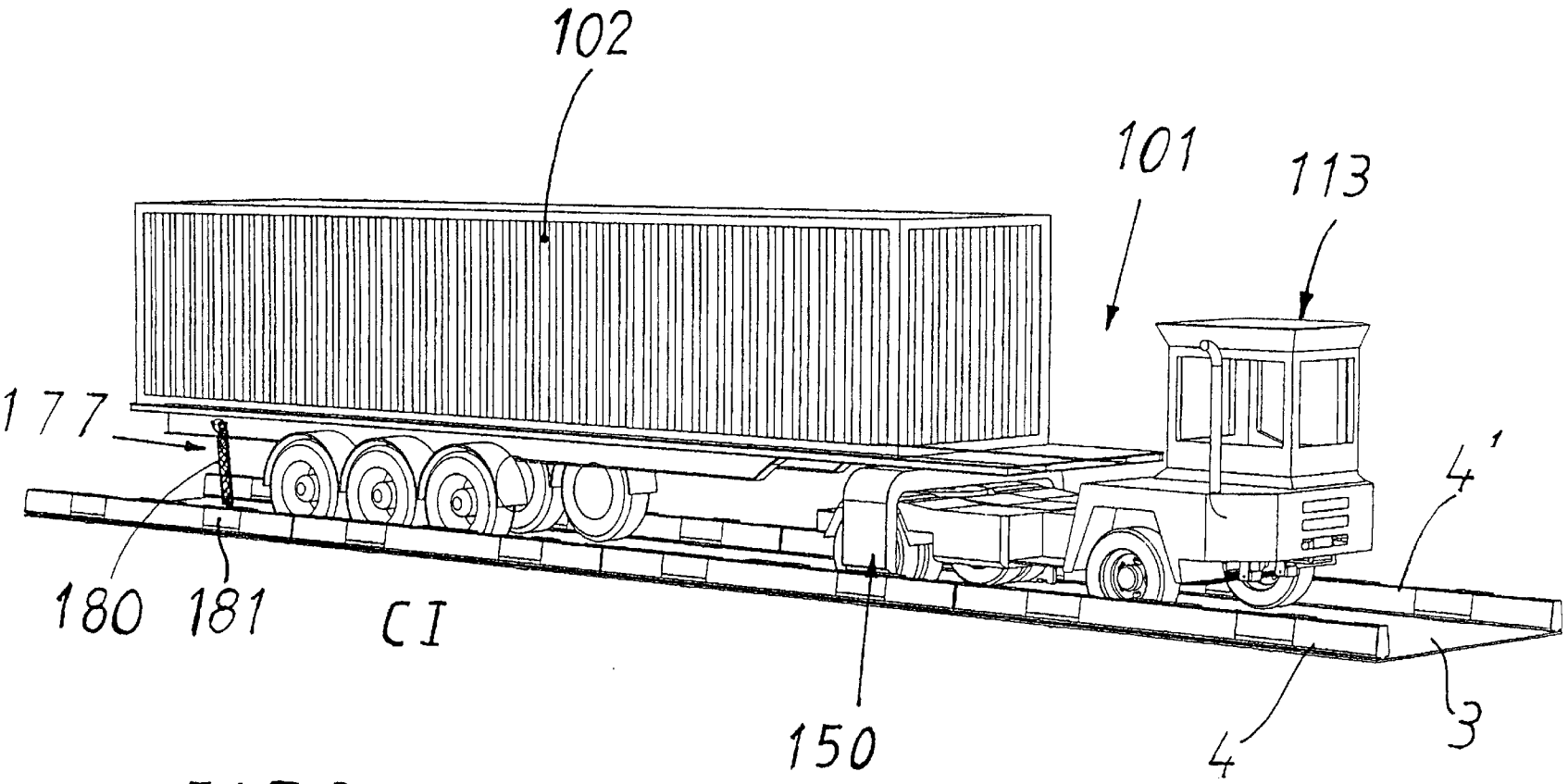
Figure 10:
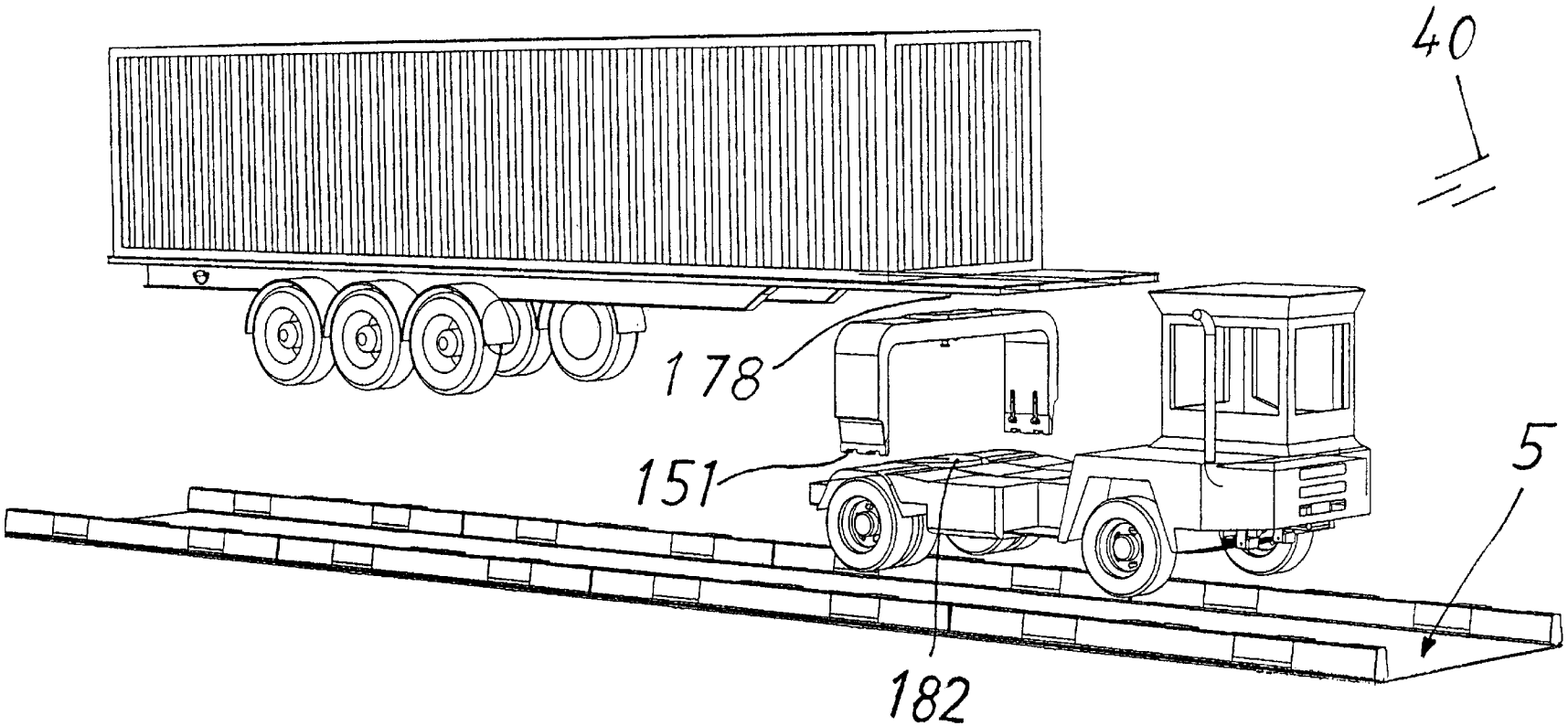
Figure 11:
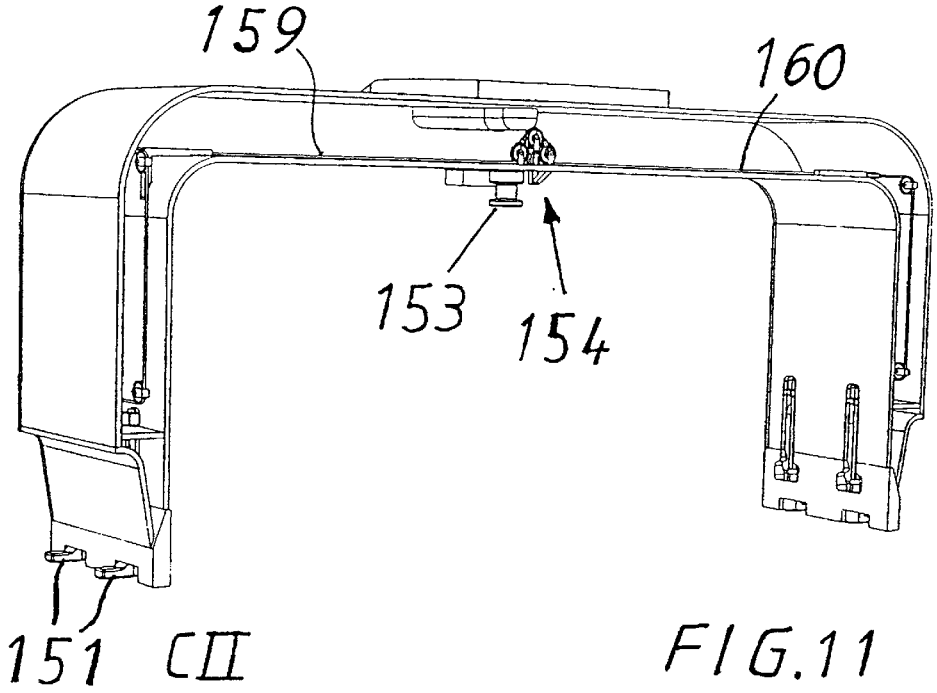
Figure 12:
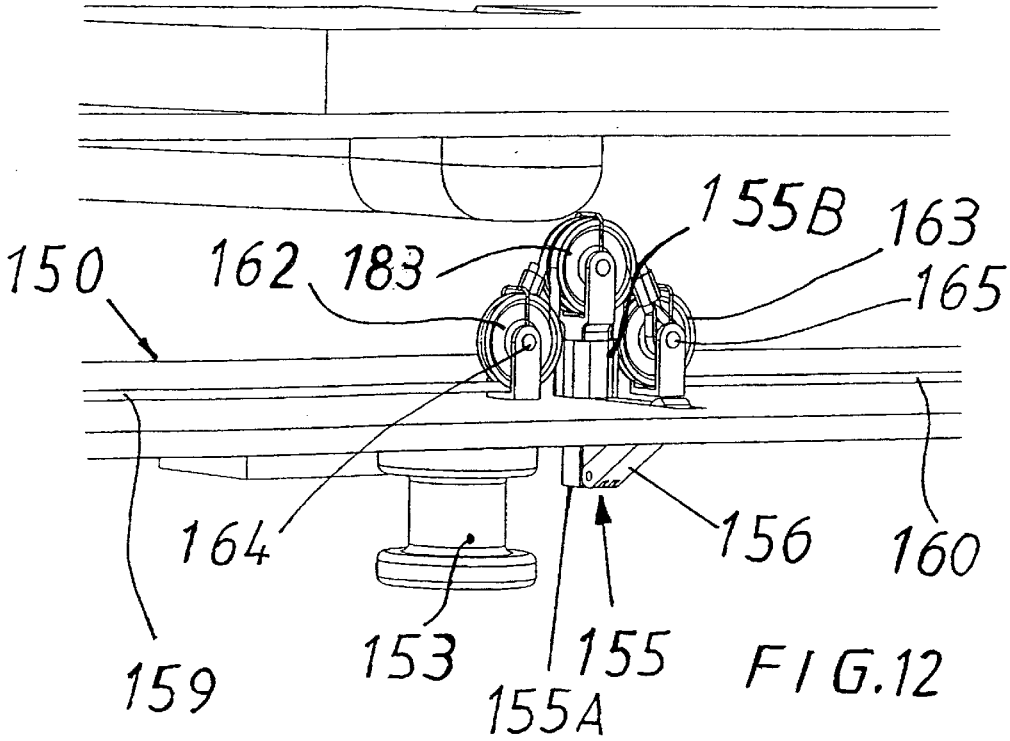
Figure 13:
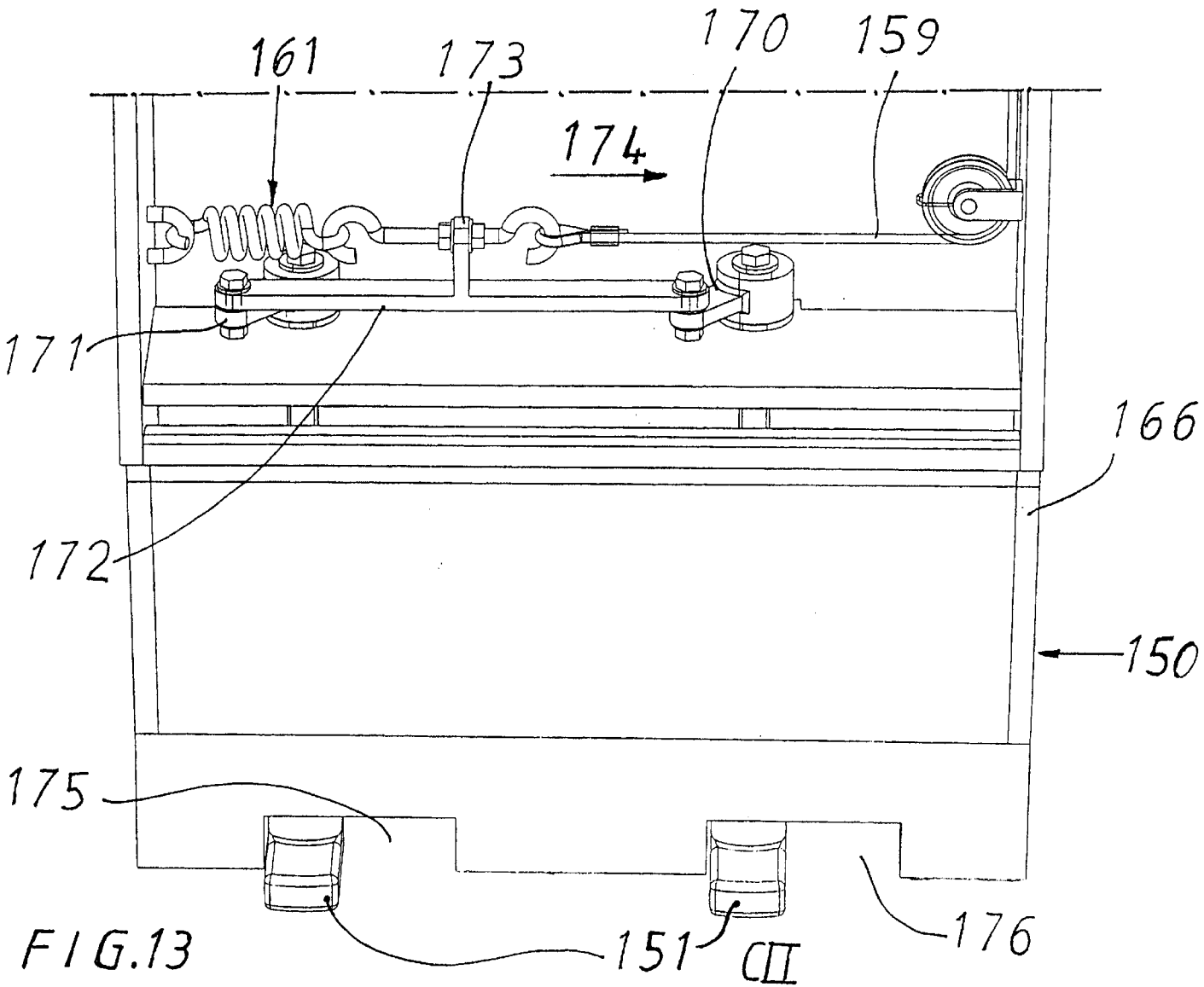
Figure 14:
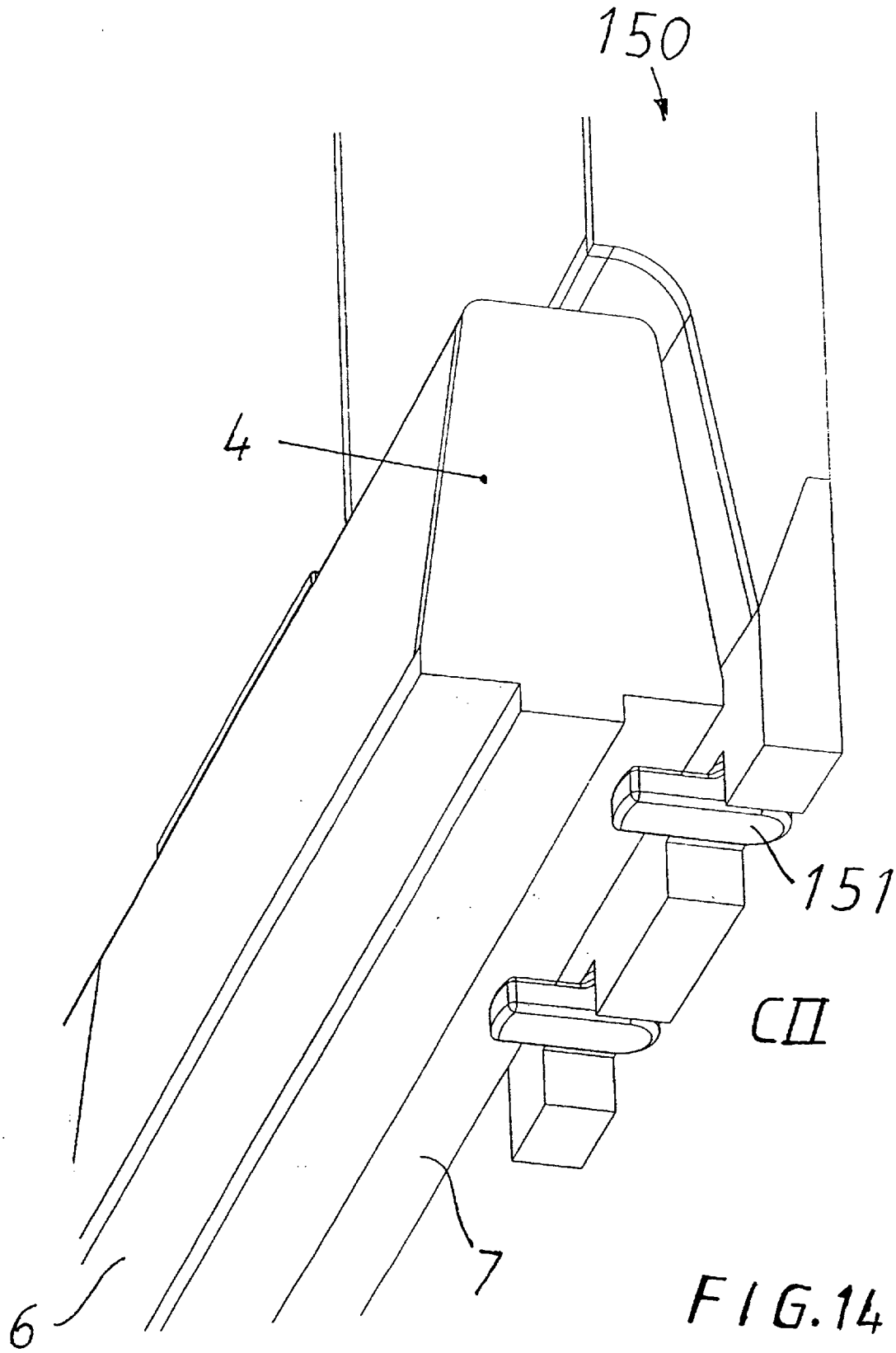
Figure 17:
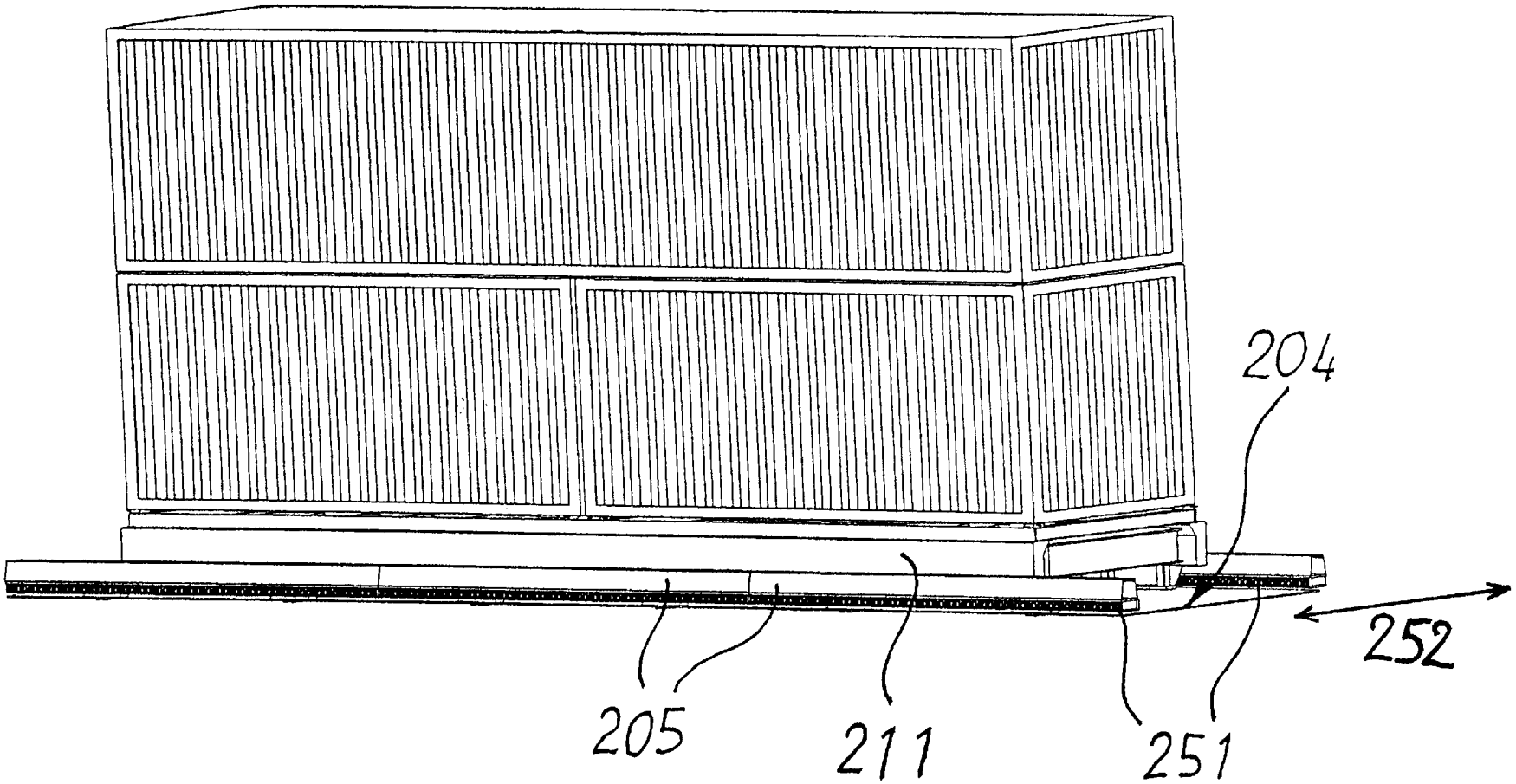
FIGS. 17–23 show different embodiments of locking devices accommodated in lateral dividing profiles.
Figure 18:
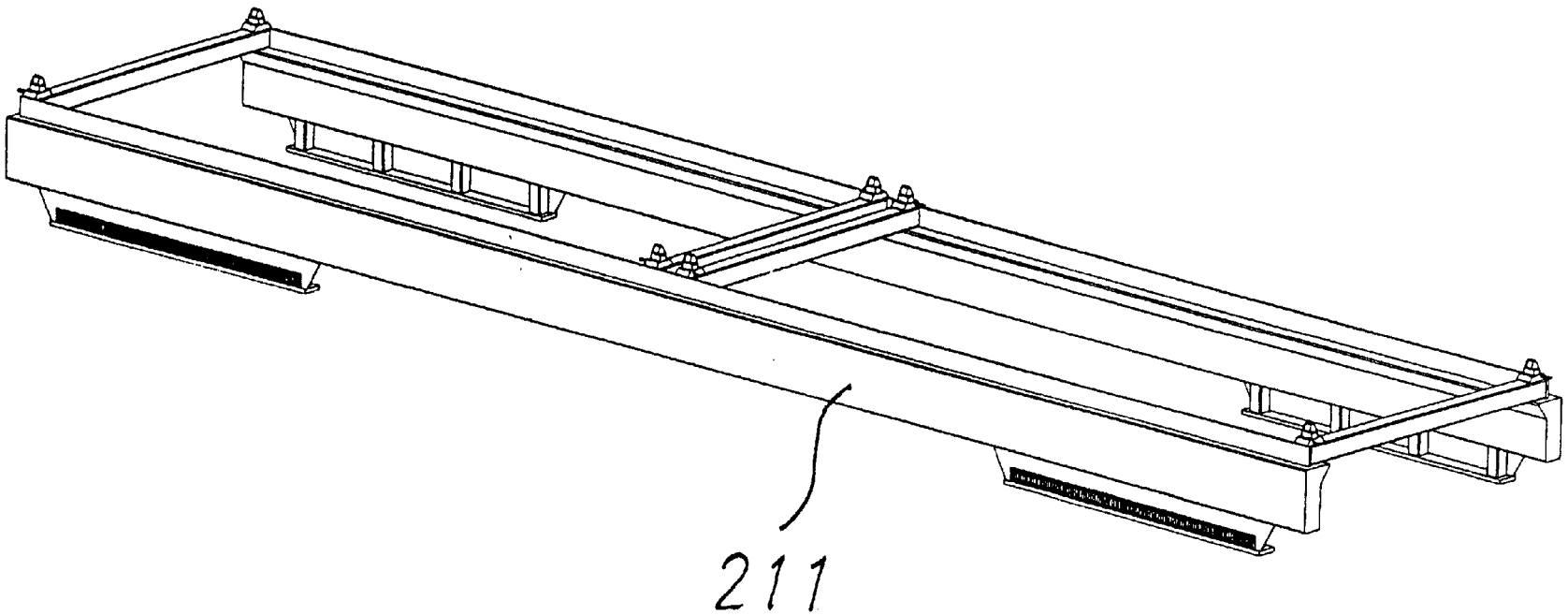
Figure 19:
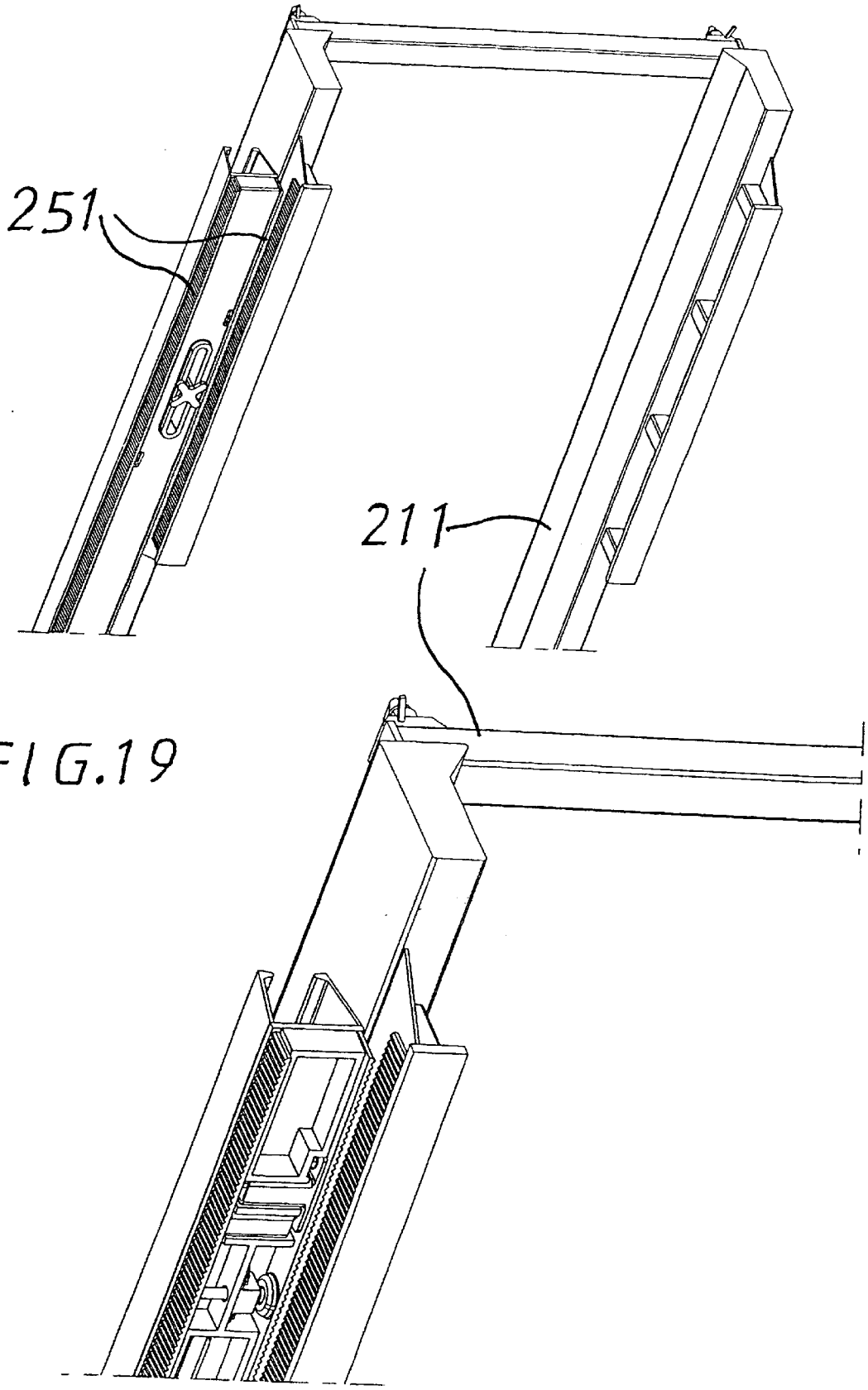
Figure 20:
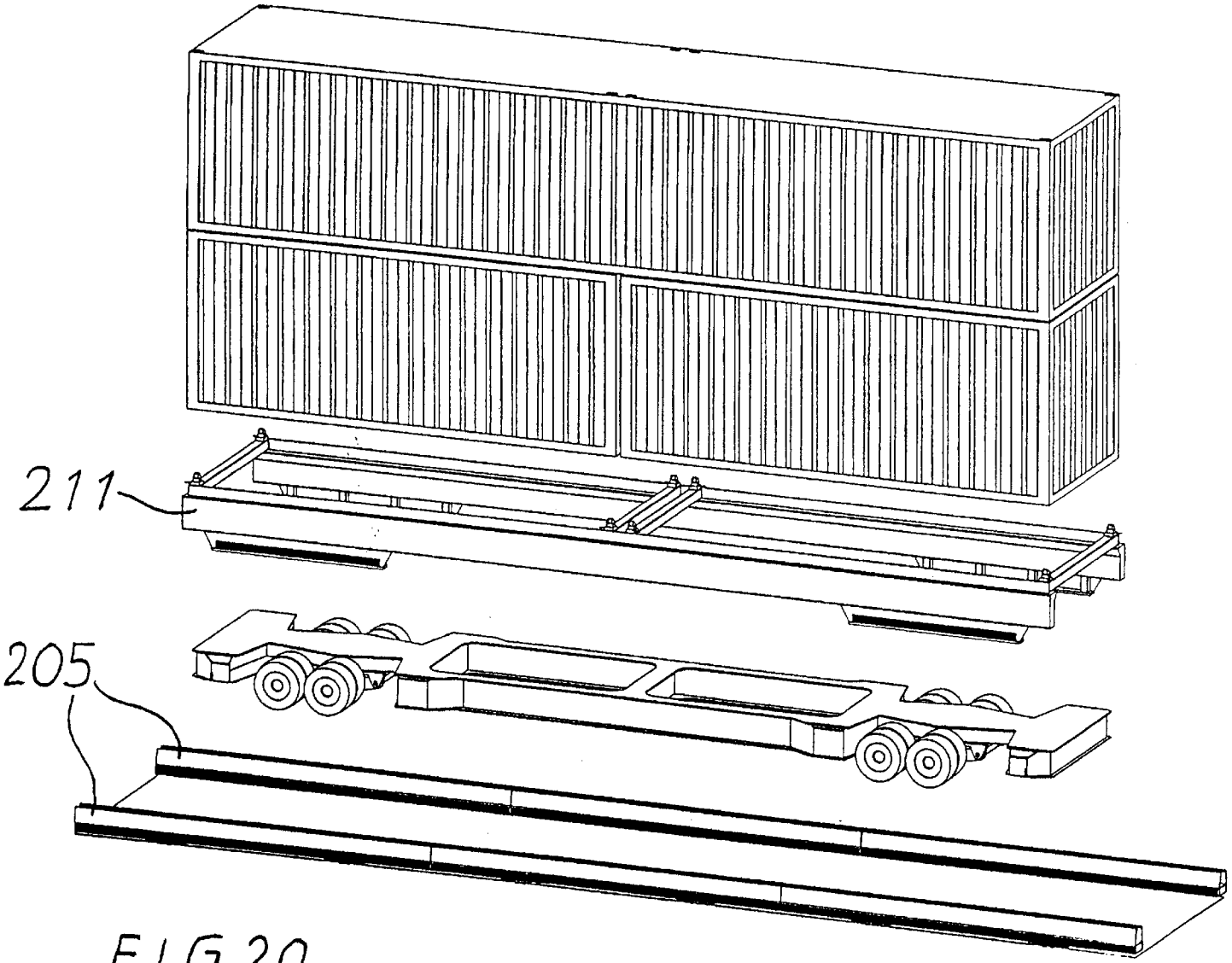
Figure 21:
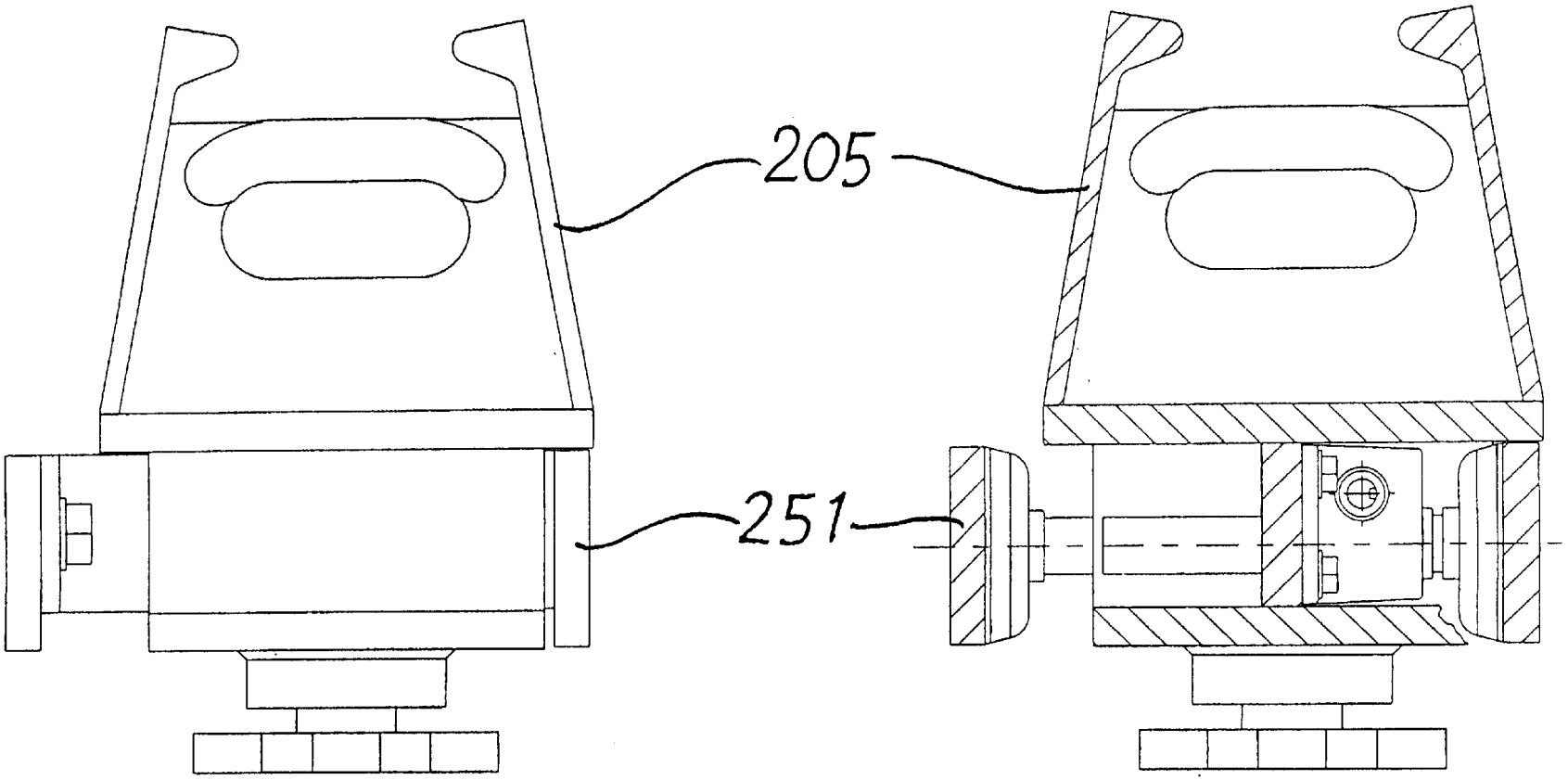
Figure 22:
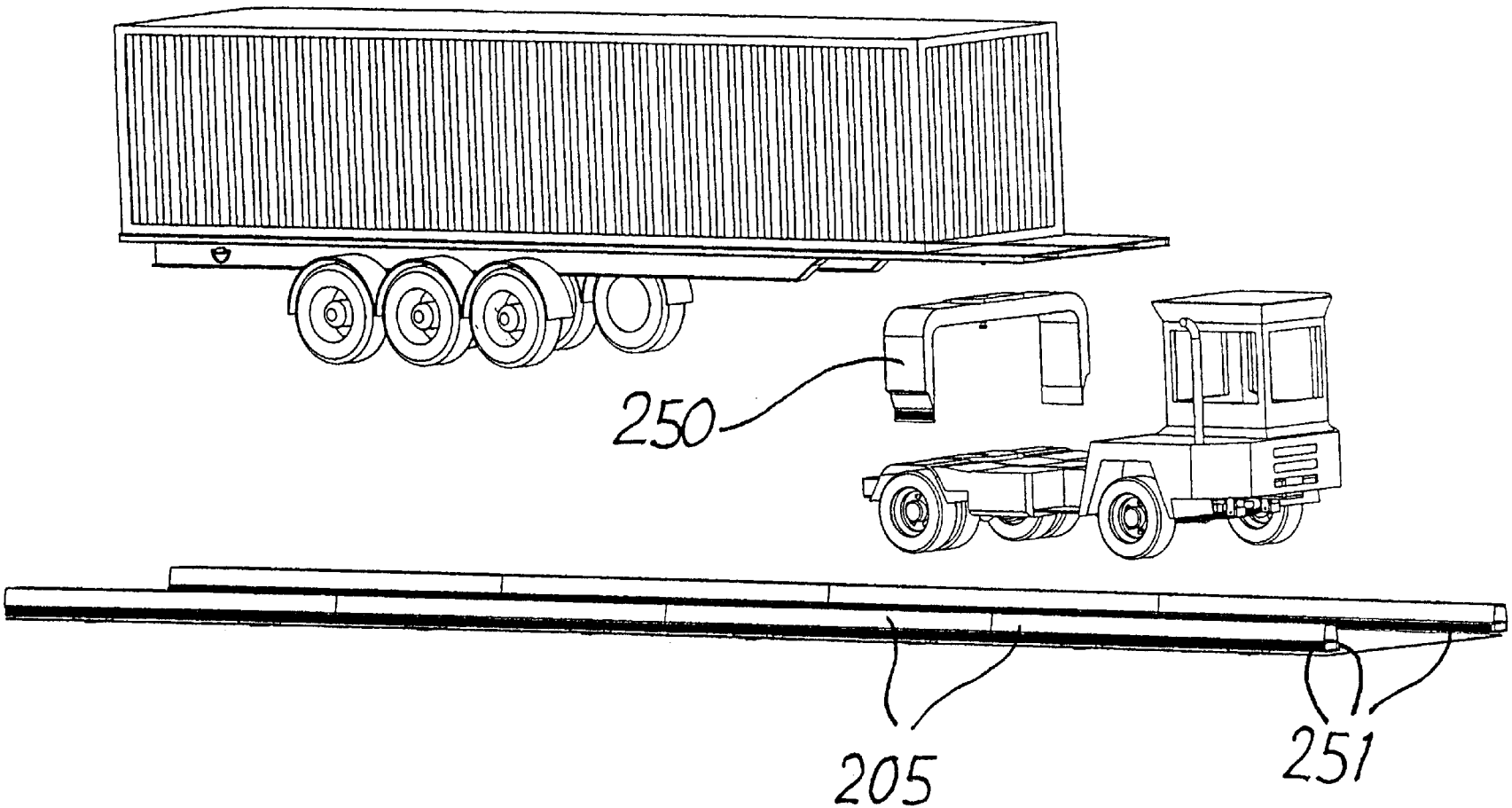
Figure 23:
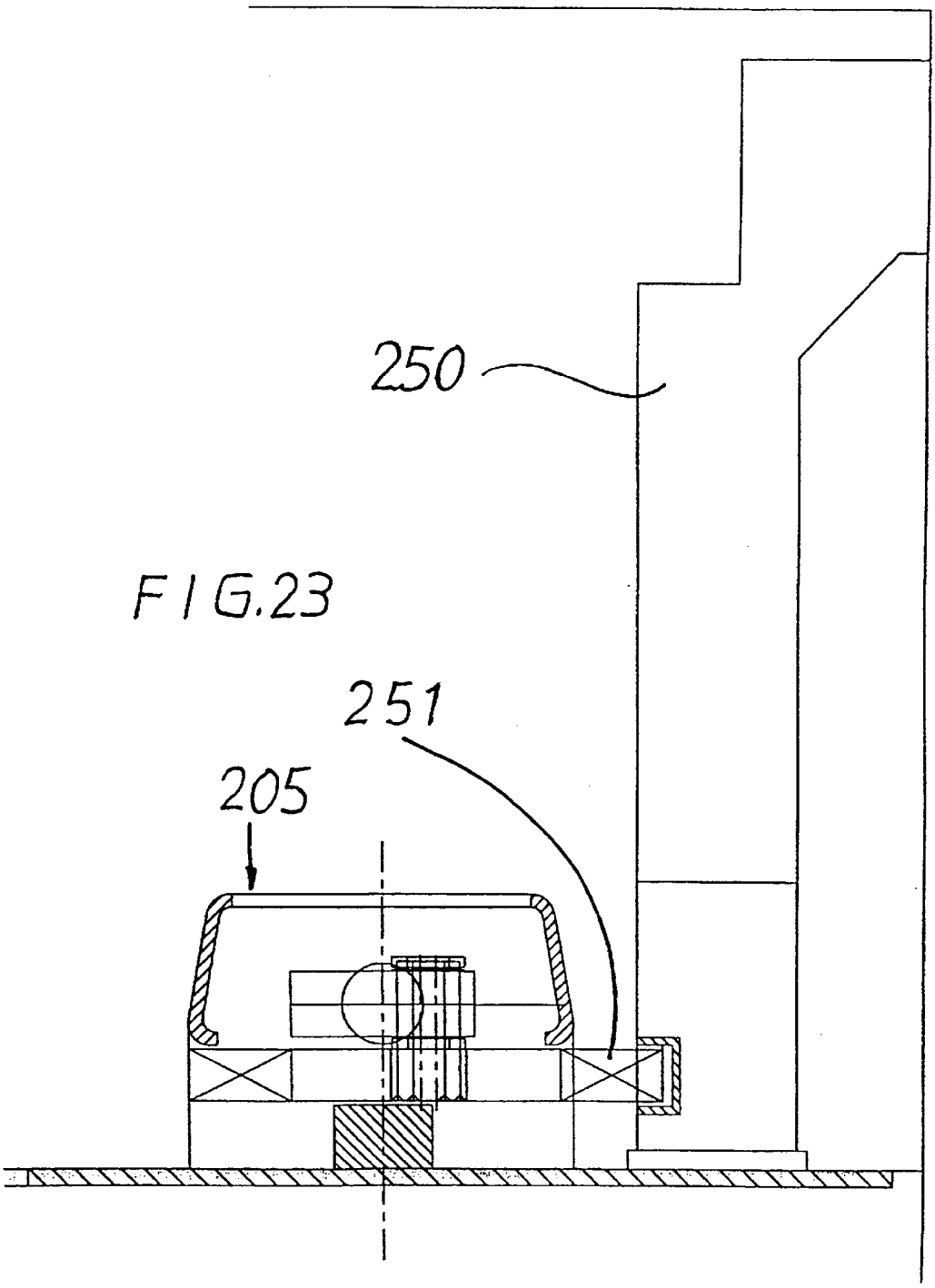

Referring to FIG. 8, the aforementioned lateral dividing profiles 4, $\mathbf{4}^1$ appropriately exhibit in accordance with a number of illustrative embodiments channel-like lock accommodating openings 6, 7, which are situated at the lower end 4A of the profiles to either side of a stand part 8 forming the bottom, from which a number of securing devices 9 project in a direction downwards, appropriately in the form of a laterally extending retaining component 10 attached to an upright 38 which can be tightened from the inside of the profile 4 after the retaining component has been introduced into a match opening in the deck 3.

In this way, the profile 4 is clamped securely to the deck 3 and forms lane dividers when driving cargo along it on the deck 3.

The lateral lock-accommodating openings 6, 7 are adapted in size to accommodate rotatable and/or movable locking devices 151, 12 from trailer supports 150 and/or cargo cassettes 11 capable of being parked in the cargo lane 5 on the deck. Present on the trailer support 150 and/or the load cassette 11 in question is a mechanism 14, 154 which is connected to the aforementioned locking device for the purpose of releasing I, CI or locking II, CII the trailer support 150 or the cargo cassette 11. A cargo vehicle 13, 113, which can be driven along and between the profiles 4, 4$^1$, is so arranged as to actuate the mechanism 14, 154.

In accordance with the invention illustrated in the drawings in FIGS. 9–16, the aforementioned trailer support 150, which is formed appropriately by a portal-shaped support component with a connecting pin 153 on its underside and internally within it, which pin is capable of detachable attachment to a cargo tractor vehicle 113 of the kind in question, has a mechanism 154 capable of actuation by the tractor vehicle. The aforementioned mechanism is so arranged, as a result of actuation by the cargo tractor vehicle 113, as to cause the locking devices 151 in the trailer support stand 150 to be moved into a released position CI in which they are disengaged from the profiles 4, 4$^1$. When the cargo tractor vehicle 113 is disconnected from the trailer support, the locking devices 151 in the trailer support 150 are so arranged as to be positively guided into a locked position CII.

Present in conjunction with this is a spring element 161 in the form of a draw spring, which is so arranged, when in the unactuated position by the cargo tractor vehicle 113, as to cause the locking devices 151 to move to the locked position on CII and into engagement with the profiles 4, 4$^1$ and their lock-accommodating openings 6, 7 in the profiles 4, 4$^1$.

The aforementioned actuating mechanism 154 is formed by an actuating component 155 capable of being pushed in by the cargo tractor vehicle 113, for example by means of its turntable 182, situated on the side of a kingpin 153, which actuating component in the case illustrated here is formed by a vertically guided upright which, with its bottom part 155A, is attached in an articulating fashion to a pivoting arm 156. Supported on the top part 155B of the upright is a rotating pulley wheel 183, which is so arranged as to extend along a plane extending in the longitudinal median plane 157 of the trailer support 150. The aforementioned actuating component 155 is attached via cables 159, 160 to the locking device 151 in question and a spring 161.

The function of the aforementioned defined arrangement 101 should have been appreciated from the above description, although briefly it functions as follows:

A cargo vehicle 113 reverses in under a trailer support 150 of the kind in question, in conjunction with which the mechanism 154 is caused by the cargo trailer vehicle 113 and its turntable 182 to push in the actuating component 155. The two cables 159, 160, each of which is attached to the axle 164, 165 of its own deflector pulley 162, 163, are tensioned in conjunction with this. The springs 161, one in each trailer support leg 166, 167, normally try to pull on the locking devices 151 so that they adopt their locked position; see FIG. 13. The locking devices can be in the form of pairs of pivotally mounted blocks 151, each of which is rigidly attached to its own vertical axle 168, 169. Each of the aforementioned axles 168, 169 is rigidly attached to its own horizontal arm 170, 171, which with the help of an articulated connecting link arm 172, provides simultaneous pivoting of the locking devices 151.

The link arm 172 has a support 173, to which the spring 161 and the cables 159 and 160 on the other leg are attached. Pulling on the cable in the direction 174 causes extension of the spring 161, in conjunction with which the axles 168, 169 rotate in the locking devices 151 in the associated cavity 175, 176 in the trailer support legs 166, 167, after which the trailer support 150 will rave been released from engagement with the locking devices 151 In the matching lock-accommodating openings 6, 7 in the profiles 4, 4. The cargo trailer 177 can then be connected to its kingpin 178 in a turntable 179 on the top side 150B of the trailer support 150.

After the rig has reversed into the ship between the profiles 4, 4$^1$, the cargo tractor vehicle 113 is disconnected from the cargo trailer and the trailer support 150, in conjunction with which the actuating component 155 is caused to be displaced downwards when the spring 161 relaxes, and the locking devices 151 are caused to pivot out into the locked position. The arrangement 101 thus has a simple and effective function. The rear part of the cargo trailers is attached securely to the deck 3 by means of straps 180, which are normally kept rolled up in compartments 181 in the profiles.

The nature of the embodiment in accordance with the other drawings 1–8 is such that the cargo cassettes 11 exhibit a centrally located space 15 to accommodate a cargo vehicle 13, which has lifting means enabling a cassette 11 to be hoisted to the desired level for transport or setting down on the deck 3. Projecting actuating devices 16–16$^3$ are provided and are so arranged as to be actuated by the cargo vehicle 13 as it drives into the inner space of the cassette 15 in both directions of travel 17, 18. A rotating component 19, which is rotatably attached to a rotatable locking device 12, has a number of such radially projecting pivot pins 16–16$^3$, which are connected to the rotating component 19.

The aforementioned cargo vehicle 13 exhibits lateral stops 20, 21 at each end 13A, 13B of the vehicle to either side of it. The aforementioned stops 20, 21 project laterally in order to come up against an actuating device 16–16$^3$ as the cassette 11 passes internally 15 therein.

One part of a laterally projecting pin 16–16$^3$ attached to the rotating component 19 is guided in such a way as to be capable of actuation in a V-shaped slot 22 in a flat part of the frame 23 of the cassette 11. The locking device 12 is pivotally 25 connected via a universal joint 24 to a rotating component executed as an axle 19 for the purpose of its lateral displacement.

The V-shaped slot 22 is arranged with its meeting point 26 situated between straight elongated openings 27, 28 which meet one another and extend upwards at an angle facing in a direction downwards directly in line with an aforementioned laterally projecting pin 16–16$^3$. The pin 16–16$^3$ is thus capable of actuation by a spring 29 causing it to be positively guided in a downward direction towards the bottom of the aforementioned V-shaped slot 22, i.e. the aforementioned centrally located meeting point 26.

The rotating component 19, which is accommodated internally in a U-shaped frame 30, which is open in an upward direction, in one side 31 of which a horizontal opening 32 is present, through which pins 16–16$^3$ project laterally, supports a freely moving ring 33 on its external boundary surface 19A. The ring 33 is provided with, for example, four radially projecting pivot pins 16–16$^3$. A compression spring 29 is accommodated by the rotating component 19 acting between the upper part 33A of the ring 33 of the rotating component and a stop 34 located at a higher point for the purpose of producing compression of the aforementioned ring 33 of the rotating component until it is level with the bottom 26 of the V-shapes groove. A slotted sleeve 35 is permanently attached to the under part 33B of the ring 33 of the rotating component, and a rotation-transmitting component 37 accommodated in the slot 36 is permanently connected to the rotating upright 19.

The ring 33 of the rotating component is capable of axial movement along a section of the aforementioned upright 9, but is positively guided in its direction of rotation, in conjunction with which the locking mechanism 14 is so arranged, in conjunction with actuation by a vehicle 13, as to be positively guided towards locking position II and locking position I when an aforementioned vehicle 13 passes below the cassette 11, and the pins 16–16$^3$ are caused to rotate with their lateral stops 20, 21 situated at the front and rear, so that the locking device 12 which is connected to the upright 19 also rotates.

This embodiment should have been appreciated from the above description.

The embodiments in accordance with FIGS. 17–23 differ from those described above and the illustrative embodiments of the invention shown in earlier Figures. The embodiment shown in FIGS. 17–21 comprises locking devices in the form of a number of long, rail-like locking profiles 251 which are actuated, for example by jacks, causing them to be displaced horizontally in a direction 252 across the cargo-accommodating lanes 204 in question and the lateral dividing profiles 205 set out in pairs.

A mechanism can thus be provided on the trailer support 250 and/or the load cassette 211 in question or on the lateral dividing profiles 205 in question, which are not shown in the drawings. The aforementioned mechanism is connected to the aforementioned locking device in order to release and lock the-locking device. A cargo vehicle which is capable of being driven along the profiles 205 and between them is so arranged as to actuate the mechanism automatically when the cargo vehicle in question passes the mechanism.

The invention is not restricted to the illustrative embodiments described above and shown in the drawings, but may be varied within the scope of the patent claims without departing from the idea of invention.

What is claimed is:

1. Arrangement for locking cargo to a deck on board a ship, characterized in that lateral dividing profiles, which are capable of being laid out on the deck and secured thereto, to form loading lanes between pairs of rows of profiles, have lock-accommodating openings to accept movable locking devices from trailer supports being capable of being parked in the loading lane, the profiles are arranged as to interact with trailer supports capable of being parked in the loading lane, connected to the locking device is a mechanism for the purpose of releasing and locking the locking device, the trailer supports are capable of detachable attachment to a cargo vehicle which can be driven along and between the profiles, and is so arranged as to actuate the mechanism, the trailer support, which is formed appropriately by a portal-shaped component with a connecting plate capable of detachable attachment to a cargo vehicle, has a mechanism capable of actuation by the cargo vehicle, which is so arranged, as a result of actuation by the cargo vehicle, as to cause the locking devices in the trailer support to be moved into a released position in which they are disengaged from the profiles and in that, when the cargo vehicle is disconnecting from the trailer support, the locking devices in the trailer support are so arranged as to be positively guided into a locked position.

2. Arrangement in accordance with claim 1, characterized in that a spring element is present, which is so arranged, when in the unactuated position by the cargo vehicle, as to cause the locking devices to move to the locked position and into engagement with the profiles and the lock-accommodating openings in the profiles.

3. Arrangement in accordance with claim 2, characterized in that actuating mechanism is formed by an actuating component, capable of being pushed in by the cargo vehicle, which is attached via cables to the locking device and a spring.

4. Arrangement for locking cargo to a deck on board a ship, characterized in that lateral dividing profiles, which are capable of being laid out on the deck and secured thereto to form loading lanes between pairs of rows of profiles, have lock-accommodating openings to accept movable locking devices from cargo cassettes being capable of being parked in the loading lane, the lateral dividing profiles, are so arranged as to interact with the cargo cassettes capable of being parked in the loading lane, connected to the locking device is a mechanism for the purpose of releasing or locking a cargo vehicle which can be driven along and between the profiles and is so arranged as to actuate the mechanism when the cargo vehicle passes the mechanism and that the cargo cassettes have actuating devices projecting laterally inwards into a centrally located space of the cassette to accommodate a cargo vehicle as it passes through the internal spaces of the cassettes in both directions of travel.

5. Arrangement in accordance with claim 4 wherein the locking devices are rotatable.

6. Arrangement in accordance with claim 4, characterized in that the cargo vehicle exhibits stops at each end, which project laterally to contact the mechanism as the cassettes pass internally therein.

7. Arrangement in accordance with claim 6, characterized in that a rotating component, which is rotatably attached to the locking device, has a number of radially projecting pins which are connected to the rotating component.

8. Arrangement in accordance with claim 7, characterized in that the one part of a laterally projecting pin attached to the rotating component is guided in such a way as to be capable of actuation in a v-shaped slot, in a part of the frame of the cassette.

9. Arrangement in accordance with claim 8, characterized in that the v-shaped slot is arranged with its meeting point situated between straight elongated openings which meet one another and face downwards directly in line with a laterally projecting pin, in conjunction with which the pin is so arranged as to be capable of actuation by a spring causing it to be positively guided in the direction towards the bottom of the V-shaped slot, at centrally located meeting point.

10. Arrangement in accordance with claim 8, characterized in that the locking device is connected via a universal joint to the rotating component, and an axle.

11. Arrangement in accordance with claim 4, characterized in that a rotating component, which is rotatably attached to the locking device, has a plurality of radially projecting pins which are connected to the rotating component.

12. Arrangement in accordance with claim 11, characterized in the one part of a laterally projecting pin attached to the rotating component is guided in such a way as to be capable of actuation in a v-shaped slot, in a part of the frame of the cassette.

13. Arrangement in accordance with claim 12, characterized in that the locking device is connected via a universal joint to the rotating component, wherein said rotating component is an axle.

14. Arrangement in accordance with claim 13, characterized in that the v-shaped slot is arranged with its meeting point situated between straight elongated openings which meet one another and face downwards directly in line with a laterally projecting pin, in conjunction with which the pin is so arranged as to be capable of actuation by a spring causing it to be positively guided in the direction towards the bottom of the V-shaped slot, at a centrally located meeting point.

15. Arrangement in accordance with claim 12, characterized in that the v-shaped slot is arranged with its meeting point situated between straight elongated openings which meet one another and face downwards directly in line with the laterally projecting pin, in conjunction with which the pin is so arranged as to be capable of actuation by a spring causing it to be positively guided in the direction towards the bottom of the V-shaped slot, at the centrally locked meeting point.

16. Arrangement in accordance with claim 15, characterized in that the rotating component supports a freely moving ring with pins projecting diametrically away from one another and with a compression spring acting between the upper part of the ring of the rotating component, in that a rotation-transmitting component accommodated in a slot is permanently connected to the rotating upright, and in that the ring of the rotating component is capable of axial movement along a section of the, but is positively guided towards a locking position and an unlocking position when a vehicle passes below the cassette.

17. Arrangement for locking cargo to a deck on board a ship, characterized in that lateral dividing profiles, which are capable of being laid out on the deck and secured thereto to form loading lanes between pairs of rows of profiles, have locking devices capable of lateral displacement from lateral dividing profiles which are so arranged as to interact with a lockable load capable of being parked in the loading lane, connected to the locking device is a mechanism for the purpose of releasing or locking the locking device to the lockable load that can be driven along and between the profiles and is so arranged as to actuate the mechanism when the lockable load passes the mechanism, the locking devices are capable of interacting with lock-accommodating devices on the lockable load.

18. Arrangement in accordance with claim 17, characterized in that the locking devices are capable of being accommodated in matching lock-accommodating openings in the load.

19. Arrangement in accordance with claim 17, wherein the locking devices are capable of being accommodated in matching lock-accommodating devices in the form of grooved side rails.

20. Arrangement in accordance with claim 19, characterized in that the locking devices are capable of being accommodated in matching lock-accommodating devices in the load.

* * * * *